US010113845B1

(12) United States Patent
Segeren et al.

(10) Patent No.: US 10,113,845 B1
(45) Date of Patent: Oct. 30, 2018

(54) APPARATUS FOR SHIPPING COMPONENTS OF AN EXPLOSIVE DEVICE

(71) Applicants: Adrian Segeren, Lakeside (CA); John D. Thomas, Huntsville, AL (US)

(72) Inventors: Adrian Segeren, Lakeside (CA); John D. Thomas, Huntsville, AL (US)

(73) Assignee: Ultratec Special Effects, Inc., Ontario (CA)

( * ) Notice: Subject to any disclaimer, the term of this patent is extended or adjusted under 35 U.S.C. 154(b) by 139 days.

(21) Appl. No.: 14/576,949

(22) Filed: Dec. 19, 2014

(51) Int. Cl.

| | |
|---|---|
| ***F42B 39/00*** | (2006.01) |
| ***B65D 41/00*** | (2006.01) |
| ***B65D 25/08*** | (2006.01) |
| ***B65D 81/32*** | (2006.01) |
| ***B65B 7/28*** | (2006.01) |
| ***C06B 21/00*** | (2006.01) |

(52) U.S. Cl.
CPC ..... *F42B 39/00* (2013.01); *B65B 7/28* (2013.01); *B65D 25/08* (2013.01); *B65D 41/005* (2013.01); *B65D 81/32* (2013.01); *C06B 21/0008* (2013.01)

(58) Field of Classification Search
CPC ..... F42B 39/00; C06B 45/00
See application file for complete search history.

(56) References Cited

U.S. PATENT DOCUMENTS 2,558,163 A 6/1951 Allan et al.
2,929,325 A * 3/1960 Idwal ..... C06B 31/30 102/315
3,342,132 A * 9/1967 Partridge ..... C06B 47/14 102/320
3,407,735 A 10/1968 Walter
3,741,383 A 6/1973 Wittwear
3,774,022 A * 11/1973 Dubrow ..... F21K 2/06 102/336
3,926,119 A 12/1975 Hurst
4,000,696 A 1/1977 Friant et al.
4,248,342 A 2/1981 King et al.
4,979,632 A 12/1990 Lee
5,435,250 A 7/1995 Pollock
(Continued)

FOREIGN PATENT DOCUMENTS

DE 10258743 7/2004

OTHER PUBLICATIONS

"Small Containers for Transport of Dangerous Goods," http://www.tc.gc.ca/publications/en/tp14850/pdf/hr/tp14850e.pdf, Oct. 2010.
(Continued)

*Primary Examiner* — Aileen B Felton
(74) *Attorney, Agent, or Firm* — Maynard Cooper & Gale, P.C.; Jon E. Holland

(57) ABSTRACT

The present disclosure generally pertains to a device for separating two or more components of an explosive device. The elongated hollow device has an interior space for holding the components as well as two open ends. A separator is positioned within the device, thus creating at least two non-communicating compartments. The separator prevents the premature mixing of the components. Application of compressive force onto the circumference of the separator will cause the separator to fracture, thus mixing the components. The device increases safety and lowers costs associated with shipping explosive materials by keeping the components separated until immediately before use.

23 Claims, 12 Drawing Sheets

(56) References Cited

U.S. PATENT DOCUMENTS

| | | | |
|---|---|---|---|
| 5,494,152 | A | 2/1996 | Sobczak |
| 6,187,471 | B1 | 2/2001 | McDermott et al. |
| 6,290,087 | B1 | 9/2001 | Shacklee |
| 6,347,700 | B1 | 2/2002 | Redfied et al. |
| 7,000,524 | B2 | 2/2006 | Beal |
| 7,210,409 | B2 | 5/2007 | Johnson |
| 7,416,076 | B2 | 8/2008 | Barton et al. |
| 2007/0131684 | A1 | 6/2007 | Cirillo et al. |

OTHER PUBLICATIONS

"Fire Protection Provided by Detonator Containers," http://www.cdc.gov/niosh/mining/UserFiles/works/pdfs/fppdc.pdf, Feb. 3, 2014.

49 CFR 173 of "Shippers-General Requirements for Shipments," Research and Special Programs, DOT, http://www.wbdg.org/pdfs/49cfr173.pdf, pp. 410-658, Oct. 1, 2004.

* cited by examiner

APPARATUS FOR SHIPPING COMPONENTS OF AN EXPLOSIVE DEVICE

RELATED ART

Shipping of explosives is a potentially dangerous operation and as a result is highly regulated by various government agencies. Differing levels of restrictions exist depending on the type, size and weight of the explosive material and the type of packaging utilized in shipping.

One class of explosive materials is pyrotechnics, which includes fireworks, safety matches, oxygen candles, explosive bolts and fasteners. Like other explosive devices, pyrotechnics are dangerous and must be properly packaged prior to shipping to prevent potentially dangerous accidents during transport. Pyrotechnics generally include an oxidizer (or oxidizing agent) and a fuel. An oxidizing agent is a substance that is not necessarily combustible, but may, generally by yielding oxygen, cause or contribute to the combustion of other materials. A fuel is any material that stores potential energy in a form that can be practicably released and used as heat energy. Combustion of the fuel requires the presence of the oxidizer. Separating the oxidizer and fuel sources during transport prevents fuel combustion and increases safety, thus decreasing shipping costs.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

The present disclosure generally pertains to apparatuses and methods for packing and shipping explosive materials, for instance pyrotechnics. In one embodiment, the apparatus includes an elongated hollow structure with a separator at the approximate mid-point of the structure, the separator dividing the tube into two non-communicating compartments. Each compartment is intended for separate storage of a component of an explosive device to prevent the components from prematurely mixing. In one example, the device keeps the components of an explosive device separated during transport. When intact, the separator is impermeable to explosive compounds. However, the separator is constructed from a breakable substance (for example, by application of force to the separator) so that it becomes permeable to explosive materials, and the components can be mixed when so intended. The use of the apparatus during transport of explosive materials reduces the likelihood of the two components mixing and subsequently igniting.

Figure 1A:
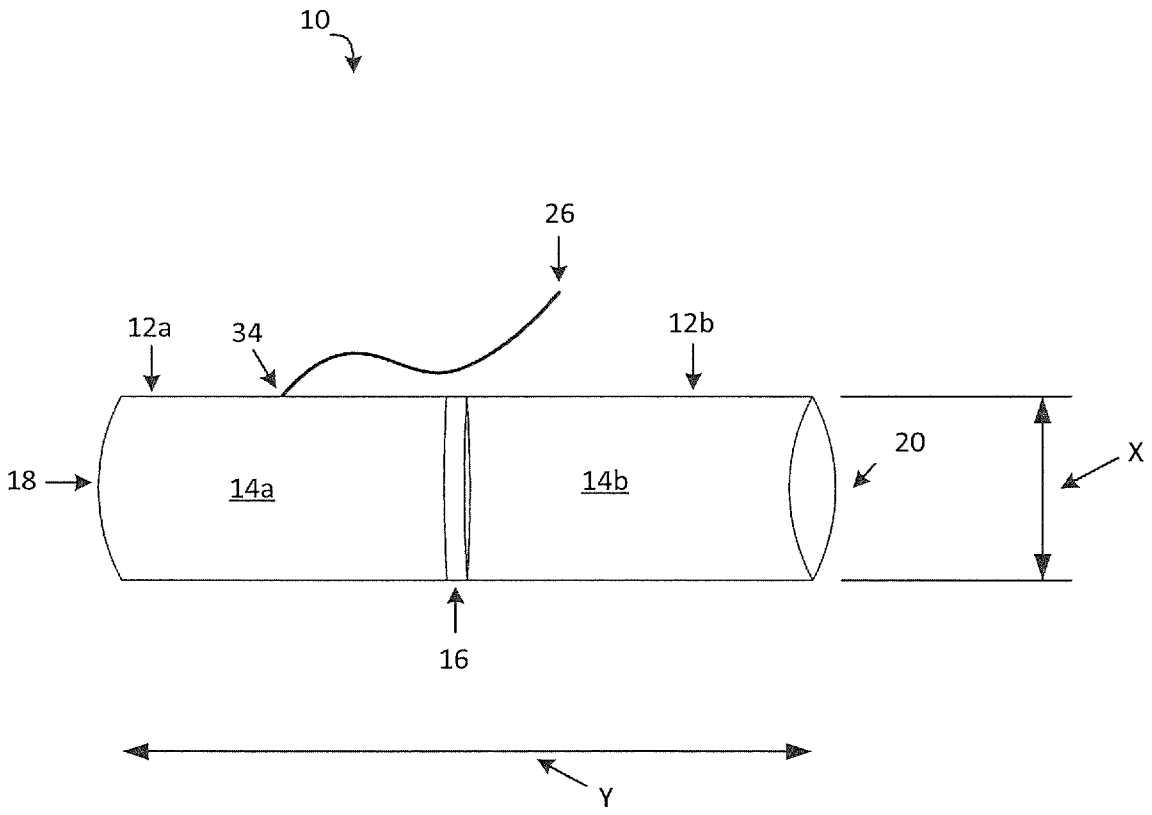
FIG. 1A depicts a side view of an exemplary embodiment of a shipping device.
Figure 1B:
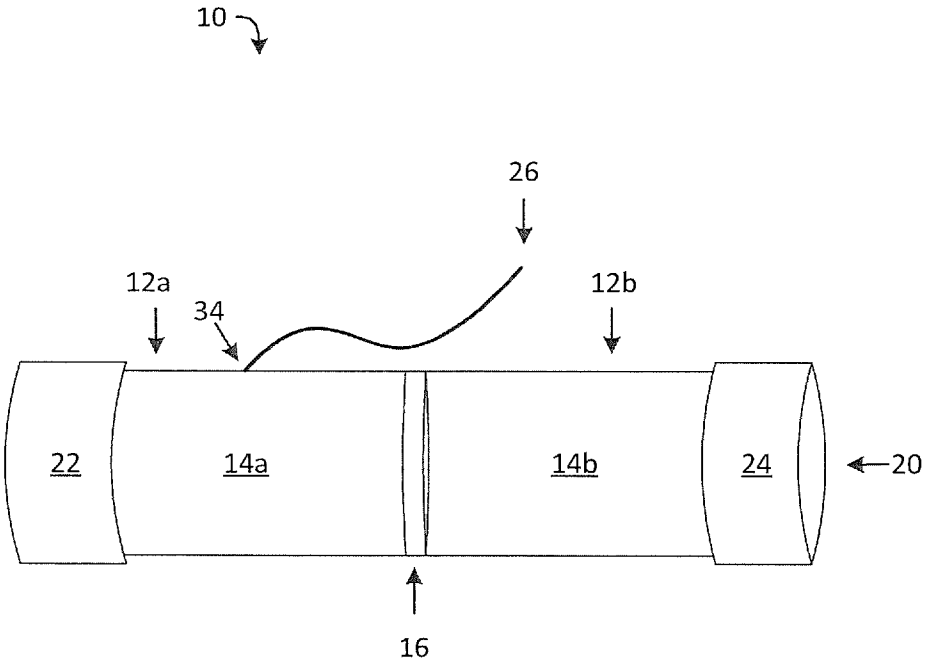
FIG. 1B depicts a side view of an exemplary embodiment of a shipping device with end caps.

FIG. 1A illustrates an apparatus 10 for use in shipping explosive materials. The apparatus 10 includes two or more coupled elongated open-ended cylindrical tubes 12*a* and 12*b* having a first open end 18 and a second opened end 20 and with at least two non-communicating compartments 14*a* and 14*b*. In one embodiment, elongated tubes 12*a* and 12*b* are hollow. Apparatus 10 may include other numbers of compartments 14 in other embodiments. The non-communicating compartments 14*a* and 14*b* are divided by a separator 16. In the embodiment illustrated in FIG. 1, tubes 12*a* and 12*b* have a substantially cylindrical shape, in that they have a circular cross sectional shape with an interior diameter represented as "X". Other shapes are possible in other embodiments, for instance square or rectangular shapes. In reference to the present disclosure, the term "tube" is therefore intended to include elongated elements with varying interior shapes. With any of these shapes, the elongated structures define an interior space designed for the separate storage of multiple components of an explosive mixture. In one embodiment, the device 10 may include a small opening 34 or hole positioned on the exterior surface of either tube 12*a* or 12*b* which is adapted to receive a detonation device 26, for instance a detonating cord, for igniting the explosive.

In the embodiment illustrated in FIG. 1A, the open-ended cylindrical tubes 12*a* and 12*b* have a diameter X of approximately 1 inch and a length Y of approximately 3 inches, although other dimensions of tubes 12*a* and 12*b* are possible in other embodiments. The dimensions of the tubes 12*a* and 12*b* are chosen to accommodate the particular type and amount of explosive material intended for transport. The materials of construction for tubes 12*a* and 12*b* are chosen such that it is pliable but durable and may withstand without tearing external forces that are typically encountered during transport. Such materials of construction may include, for example, low density heavy paper or cardboard. In one embodiment, tubes 12*a* and 12*b* are constructed from a rolled cardboard tube.

Referring now to the embodiment illustrated in FIG. 1A, each of the ends 18 and 20 of the tubes 12*a* and 12*b* may be sealed by an end cap 22 and 24, respectively. Specifically, a first cap 22 may be positioned over and mate with the first end 18 of the tube 12*a*, and a second cap 24 may be positioned over and mate with the second end 20 of the open tube 12*b* to form a closed explosives carrier. The material of construction for caps 22 and 24 may be similar to those materials used for the tube 12 (i.e., low density heavy paper or cardboard). In one embodiment, the circumference of the end caps 22 and 24 is slightly greater than the circumference of the tubes 12*a* and 12*b* so that the caps 22 and 24 may fit snugly over ends 18 and 22. In other embodiments, caps 22 and 24 may have a circumference slightly smaller than the circumference of tubes 12*a* and 12*b* so that the caps 22 and 24 snap into ends 18 and 22. In other embodiments, caps 22 and 24 may additionally include an end material (not shown) such as a clear adhesive or a heavy duty clear plastic wrap or cling material. In an additional embodiment, the end material (not shown) may be positioned to cover ends 18 and 20 while caps 22 and 24 are positioned to snap or screw onto ends 18 and 22 over the end material.

Figure 2:
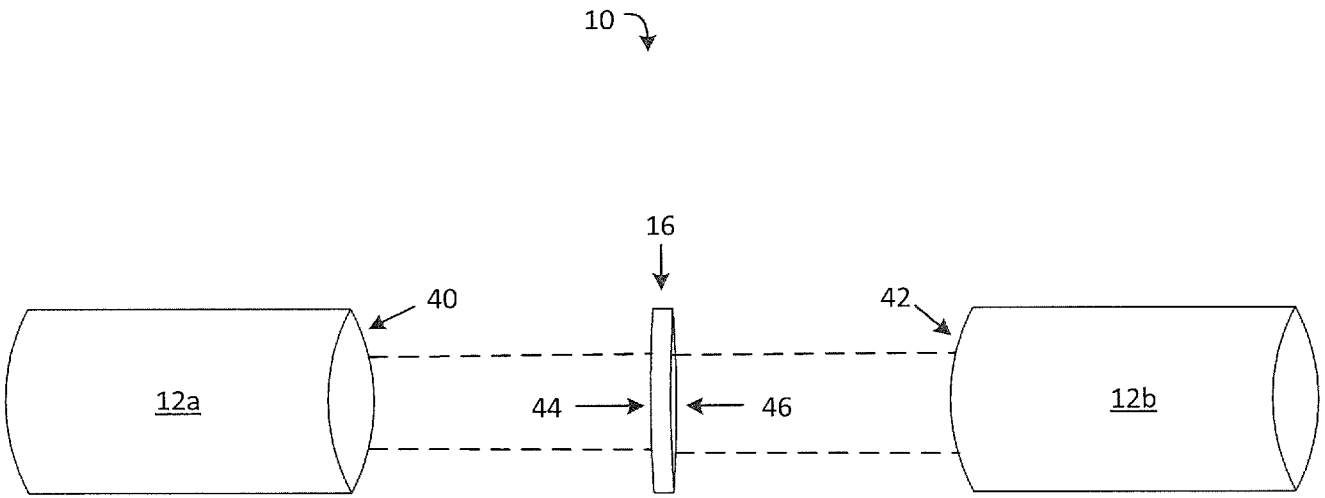
FIG. 2 is an exploded view of an exemplary embodiment of a shipping device with two elongated hollow structures.
Figure 3:
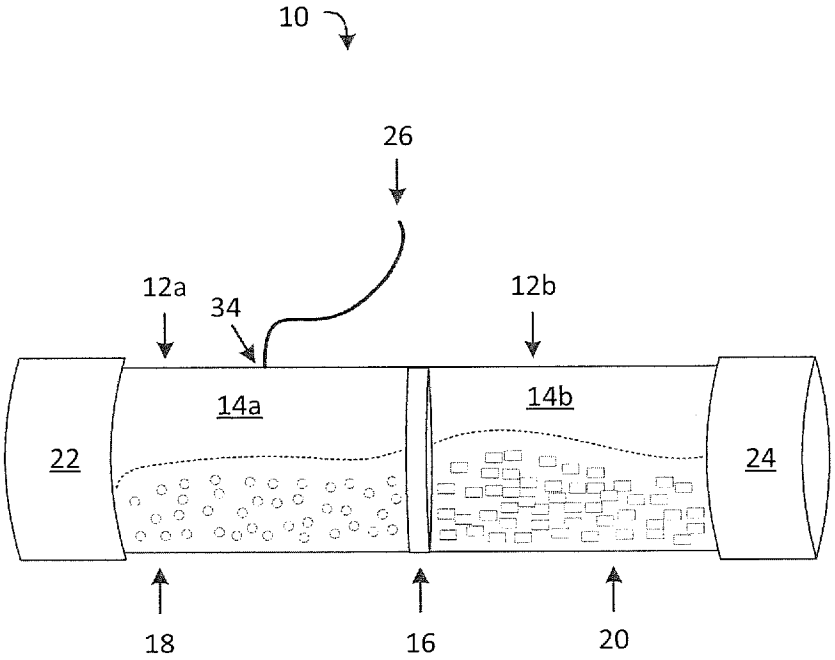
FIG. 3 depicts a side view of an additional exemplary embodiment of a shipping device with explosive components.

Referring now to FIG. 2, a separator 16 is positioned between tubes 12*a* and 12*b*. One side 44 of separator 16 is adhered to one end 40 of hollow tube 12*a* with use of an adhesive, such as a glue, cement or paste. The end 42 of a second hollow tube 12*b* is then adhered to the opposing side 46 of separator 16. Separator 16 completely covers ends 40 and 42. Adhering separator 16 in such a manner to tubes 12*a* and 12*b* creates two compartments 14*a* and 14*b* that are isolated and therefore non-communicating. With reference to FIG. 3, each of compartments 14*a* and 14*b* is intended for the separate storage of a component of a mixture, for example the components of an explosive mixture. In one embodiment, separator 16 creates compartment 14*a* which contains substance 30 and compartment 14*b* which contains substance 32. In the embodiment illustrated in FIG. 3, substances 30 and 32 represent components of an explosive material, for instance an oxidizer and fuel, respectively. The oxidizer 30 and fuel 32 remain separated and will not mix or comingle while separator 16 is intact (i.e., the separator 16 is impermeable to explosive materials). Multiple separators 16 may be coupled to create more than two non-communicating compartments, thus separating three, or more, materials. Although FIG. 3 illustrates non-communicating compartments 14*a* and 14*b* of equal size, the compartments 14*a* and 14*b* may be differently sized so as to accommodate a variety of explosive components.

Figure 4B:
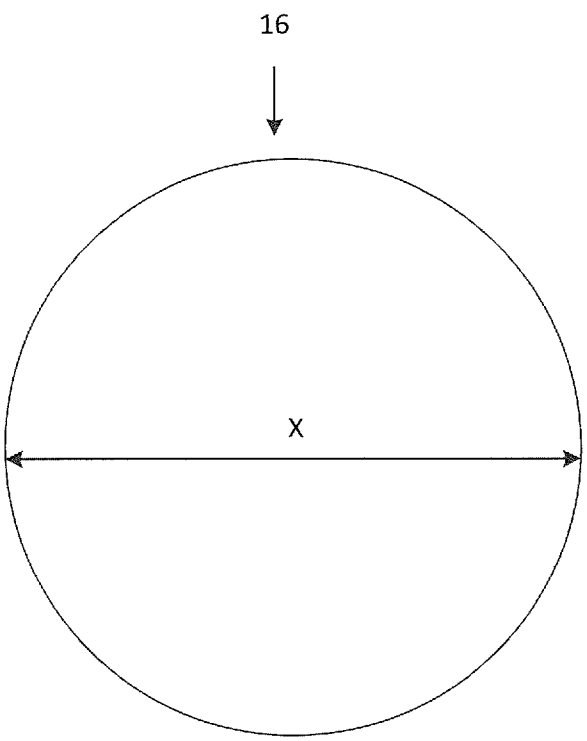
FIG. 4B depicts a top view of the separator depicted by FIG. 4A.
Figure 4A:
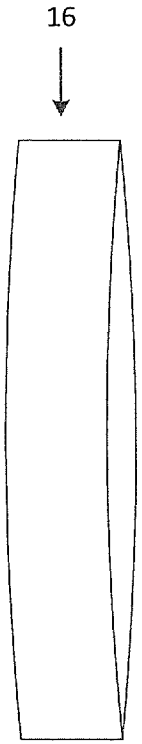
FIG. 4A depicts a side view an exemplary embodiment of a separator.

The currently described separator 16 has a size and shape that is similar to the dimensions of tubes 12*a* and 12*b*. With reference to FIGS. 4A and 4B, separator 16 has a circular cross sectional shape, with a diameter of X, greater than or equal to the interior diameter of cylindrical tubes 12*a* and 12*b* (FIG. 1A). In one embodiment, such as is depicted by FIG. 3, the separator 16 has a diameter equal to the outer diameter of tubes 12*a* and 12*b*. In such embodiment, the edge of the separator 16 is exposed allowing force to be applied by hand directly to the separator 16, as will be described in more detail hereafter. However, in other embodiments, the separator 16 may have other shapes and dimensions, and the edge of the separator 16 may be hidden.

Figure 8:
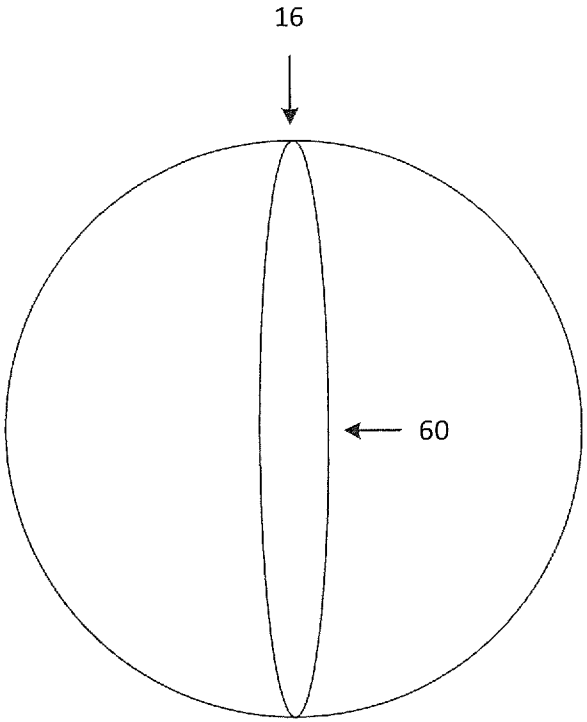
FIG. 8 depicts a top view of an exemplary embodiment of a separator including a fracture.

The separator 16 is constructed from a thin, pliable material that is resistant to tearing or breaking under the normal stresses associated with the transport of goods. The material is impermeable to the explosive materials and will therefore prevent passage of the material between compartments 14*a* and 14*b*. Such materials may include, for example, a concussion membrane capable of sustaining sheer strength when adhered to the edges of tubes 12*a* and 12*b*. In one example, the membrane separator 16 comprises a 20 lb base weight, acid free, archive safe concussion membrane providing approximately 75 g/m$^2$ sheer strength. In one embodiment, the concussion membrane separator 16 provides 40-70 Nm/g machine direction tensile strength and 20-40 Nm/g cross direction tensile strength with a 500-600 mN tearing resistance. In an additional embodiment, the material exhibits a 500-600 mN tearing resistance, 39 machine direction bending value and 17 cross direction bending value. Separator 16 will fracture when subjected to compressive forces around its circumference and thus become permeable to the explosive materials. With reference to FIG. 8, these materials will tear or rip 60 when inward pressure is applied by hand or otherwise at various points along the edge of the separator 16.

Figure 5A:
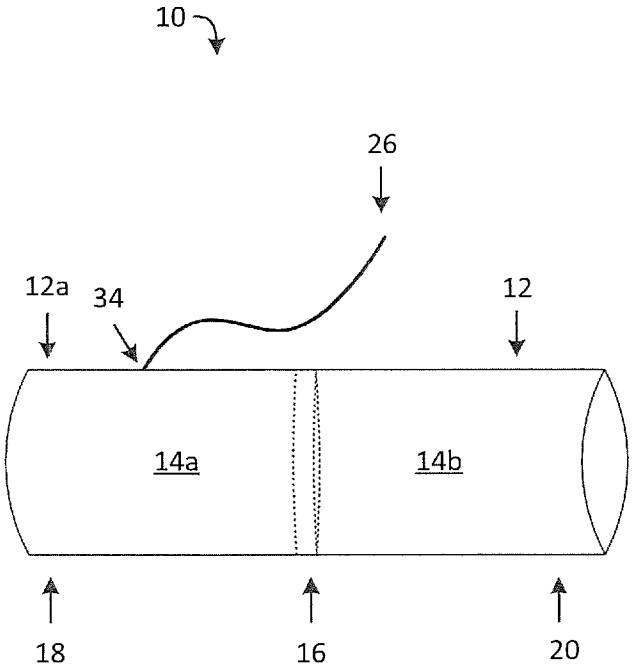
FIG. 5A depicts a side view of an exemplary embodiment of a shipping device with a single hollow tube.
Figure 5B:
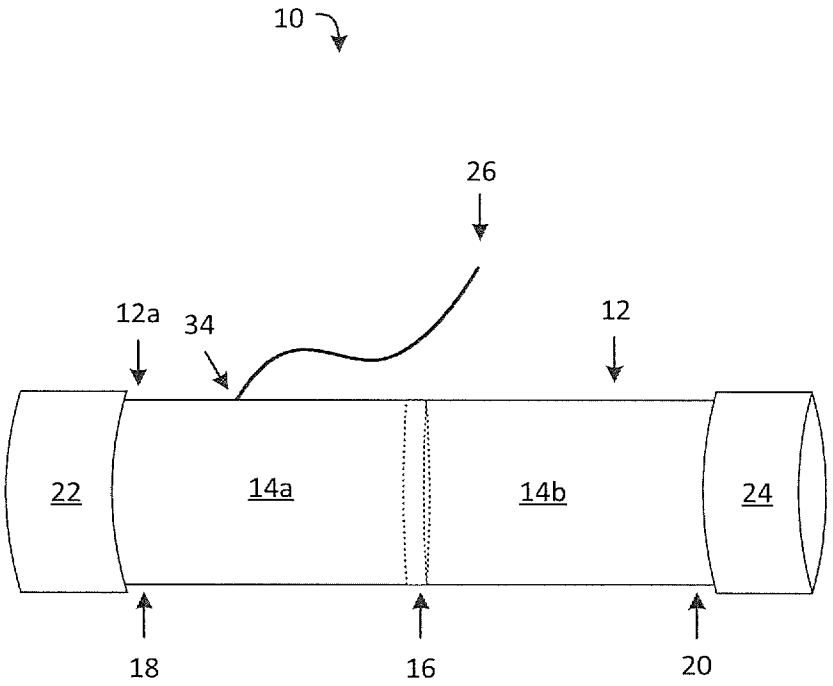
FIG. 5B depicts a side view of an exemplary embodiment of a shipping device with a single elongated hollow tube and end caps.

FIGS. 5*a* and 5B illustrate an alternate embodiment of the apparatus 10, such embodiment having similar structure as described above with the exceptions described herein. Here, apparatus 10 includes a single open-ended cylindrical tube 12 having a first open end 18 and a second open end 20 and at least two non-communicating compartments 14*a* and 14*b*. The non-communicating compartments 14*a* and 14*b* are divided by a separator 12 positioned in the interior of tube 12. Separator 16 is positioned in the interior of tube 12 at its approximate midpoint, although other locations are possible. The separator 16 may be inserted into tube 12 through one of the ends 18 or 20. After travelling a certain length into the interior of tube 12, the outer edges of separator 16 may be adhered to the interior surface of tube 12. This may be accomplished, for example, by use of glue or other adhesive.

Figure 6:
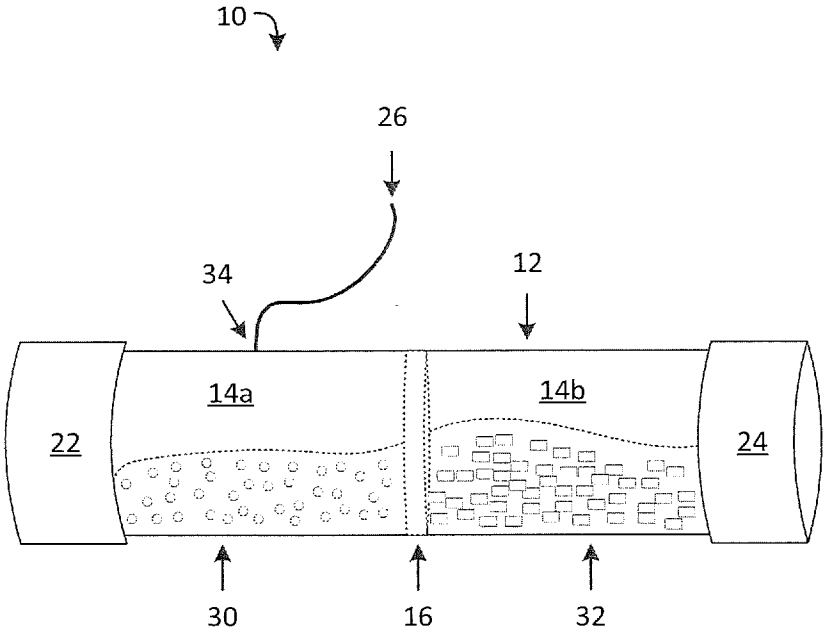
FIG. 6 depicts a side view of an exemplary embodiment of a shipping device with a single elongated hollow tube and explosive components.

With reference to FIG. 6, each of the compartments 14*a* and 14*b* is intended for the separate storage of a component of a mixture, for example the components of an explosive mixture. In one embodiment, separator 16 creates compartment 14*a* which contains substance 30 and compartment 14*b* which contains substance 32. In the embodiment illustrated in FIG. 6, substances 30 and 32 represent components of an explosive material, for instance an oxidizer and fuel, respectively. The oxidizer 30 and fuel 32 remain separated and will not mix or comingle while separator 16 is intact (i.e., the separator 16 is impermeable to explosive materials). Multiple separators 16 may be inserted into tube 12 to create more than two non-communicating compartments, thus separating three, or more, materials.

In use, the user first secures a first side 44 of a separator 16 to one end 40 of hollow tube 12*a* with use of an adhesive (FIG. 2). The end 42 of a second hollow tube 12*b* is then adhered to the opposing side 46 of separator 16. The resulting apparatus includes two non-communicating compartments 14*a* and 14*b* which are coupled by separator 16 (FIG. 1A). Separator 16 completely covers ends 40 and 42 so that the contents of compartments 14*a* and 14*b* will not discharge from the device 10. Referring to FIG. 3, a quantity of a component of an explosive material is then inserted into one side of the tube 12*a* and forced into the tube 12*a* until it contacts the separator 16. In one example, an oxidizer compound 30 is loaded into compartment 14*a*. The user then places an end material (not shown) over end 18 and then secures cap 22 over the end 18 of tube 12*a*. In other embodiments, the user may secure the cap 22 directly to end 18 of tube 12*a*. Additional quantities of an adhesive material (not shown), such as tape, may be used to further secure the cap 22 over the end 18 of tube 12*a*, for instance by applying the adhesive in a circular bead around the base of the cap 22. Once the first cap 22 has been secured to end 18 of tube 12*a*, the user may insert a quantity of a second component of an explosive device 32 into tube 12*b* and compartment 14*b* and force the component 32 into the tube 12*b* until it comes into contact with the separator 16. The end 20 of tube 12*b* is sealed with cap 24 in the same manner as described for cap 22. The caps 20 and 22 enclose and seal tubes 12*a* 12*b* to protect against leakage of the explosive device components 30 and 32. The resulting device 10 includes two non-communicating compartments 14*a* and 14*b*, each of which contains and isolates a component of an explosive device 30 and 32, thus preventing the premature mixing of components 30 and 32 during shipping. In this regard, the oxidizer 30 and fuel 32 are unable to pass through separator 16 and are therefore unable to mix.

In an alternate embodiment where apparatus 10 includes a single open-ended cylindrical tube 12, the user inserts a separator 16 into tube 12 to a desired length. Referring to FIGS. 5A and 5B, the diameter of the separator 16 is such that it will fit snugly inside tube 12. The separator 12 is then secured to the inside of tube 12 by use if an adhesive, for instance glue or tape. Positioning of the separator 16 in such a manner creates two non-communicating compartments 14*a* and 14*b*. The components of an explosive device, for example the oxidizer 30 and fuel 32 are inserted into and sealed within compartments 14*a* and 14*b* in the same manner as described above in reference to FIGS. 1A and 2. Non-communicating compartments 14*a* and 14*b* function by isolating the components of an explosive device, for instance an oxidizer 30 and fuel 32 during transport. The oxidizer 30 and fuel 32 are unable to pass through separator 16 and are therefore unable to mix.

Figure 7:
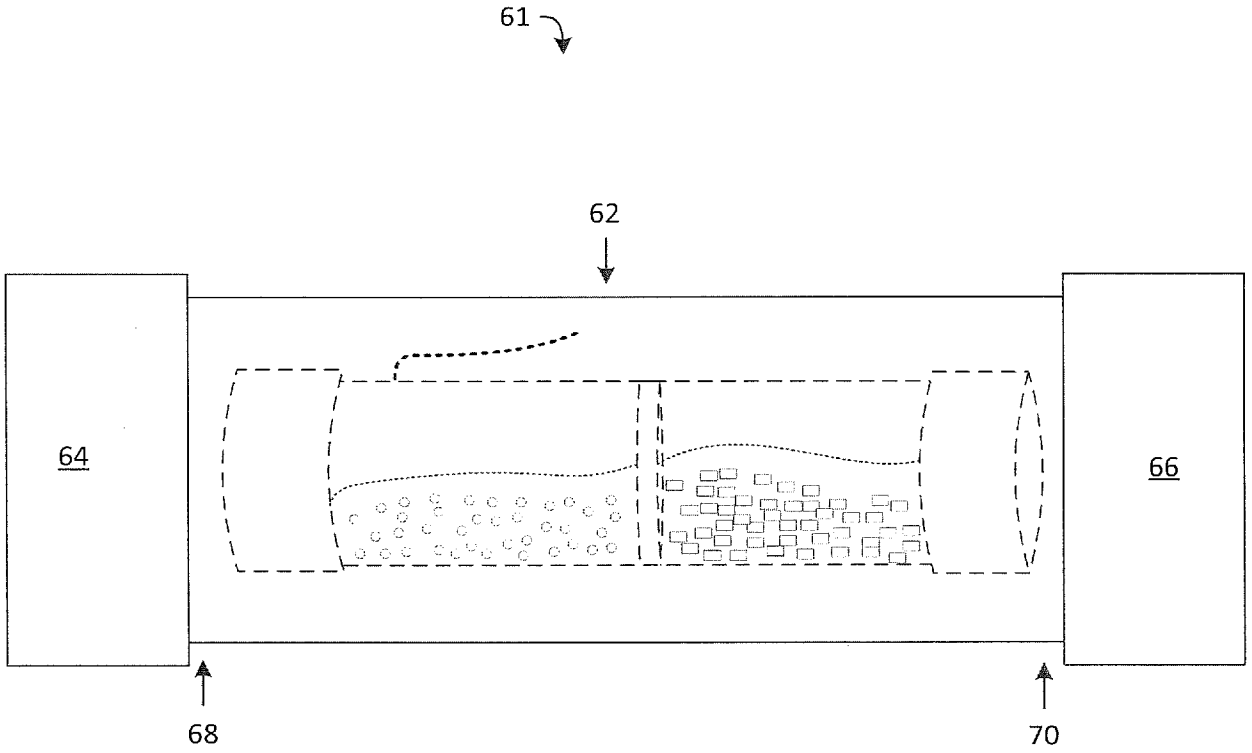
FIG. 7 depicts a side view of an exemplary embodiment of a shipping device inserted into packaging materials.

If desired, the user may then insert device 10 into additional packaging materials to assist in shipping the explosive components. Referring to FIG. 7, device 10 includes two non-communicating compartments 14*a* and 14*b*, each containing a component of an explosive compound 30 and 32. As described above, the two components 30 and 32 are sealed within their corresponding compartments 14*a* and 14*b* through the use of an impermeable separator 16 and two end caps 22 and 24. The device 10 is then placed within a tubular packaging material 61 to provide greater protection and stability during transport. Packaging material 61 is structured to accommodate device 10 in that it has the same general shape and dimensions as device 10. In the embodiment illustrated in FIG. 7, the packaging material 61 is formed as an elongated cylindrical tube 62 similar to that of tube 12 of device 10. Packaging material 61 further includes two end caps 66 and 66 which are secured to the ends 68 and 70. An adhesive material (not shown), such as tape, may be used to further secure caps 66 and 68 over the end 18 of tube 12, for instance by applying the adhesive in a circular bead around the base of caps 66 and 68.

After securing the explosive components 30 and 32 within the device 10 and the packaging material 61, the user may then position the packaged device 10 in conventional shipping containers. In one embodiment, a plurality of packages devices 10 may be placed within a single container. Such containers may be, for example, corrugated cardboard boxes which meet applicable safety and regulatory standards. The described device 10 maintains the explosive components in separate chambers during transport, reducing the risks of accidental mixing.

Figure 9:
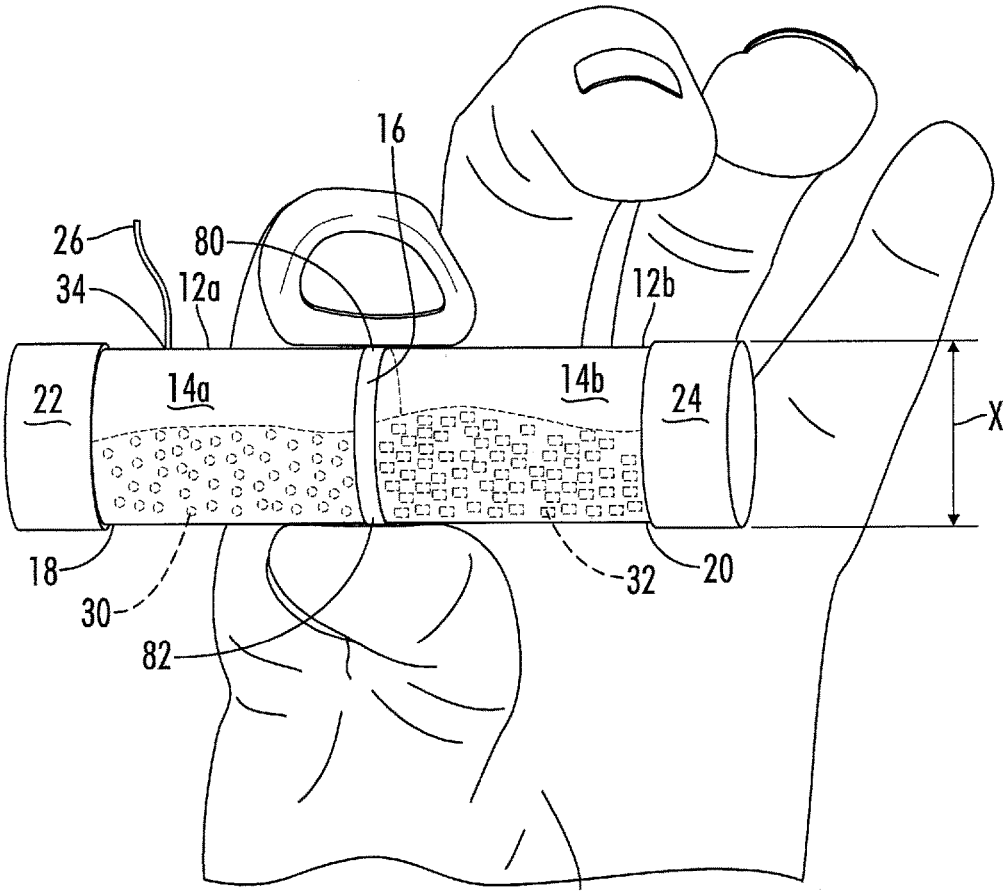
FIG. 9 depicts a side view of an exemplary embodiment of a shipping device subjected to compressive pressure.
Figure 10:
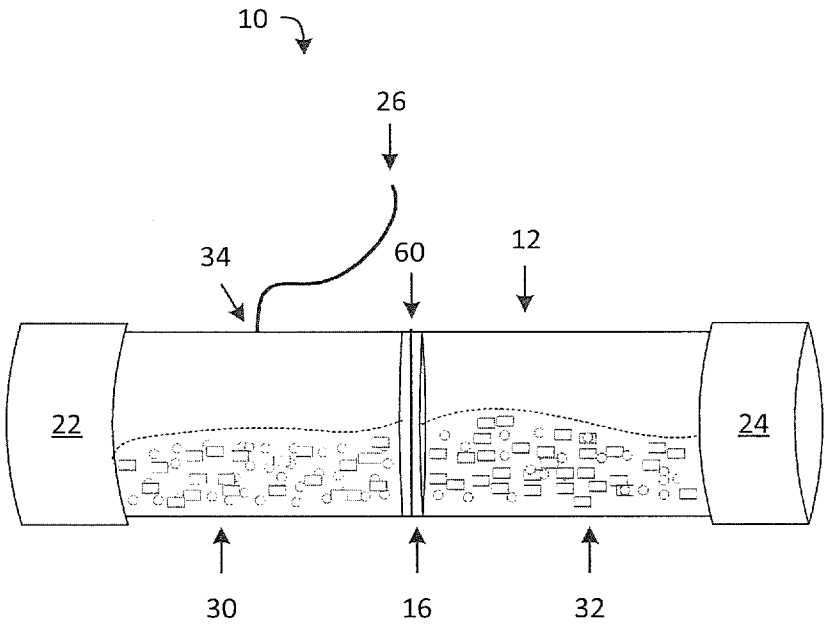
FIG. 10 depicts a side view of an exemplary embodiment of a shipping device with mixed explosive components.

Prior to use, the packaged devices are removed from both the shipping containers and the packing material 61. Before ignition, the user applies compressive force at various points along the circumference of the separator 16, as illustrated in FIG. 9. As an example, the user may place one finger at point 80 and another finger at point 82 on opposite sides of the separator 16 and squeeze the separator 16 at points 80 and 82. This compressive force is greater than those forces normally observed during transport and shipping. The direct application of compressive force fractures the separator 16 so that the substances in the compartments 14*a* and 14*b* may pass through the separator 16. That is, the fracturing of the separator 16 creates holes or otherwise separates the material of the separator 16, making it permeable to the substances I the compartments 14*a* and 14*b*. As an example, fracturing of the separator 16 may create a rip or tear 60 in the thin material of the separator 16, as illustrated in FIG. 8. This rip or tear 60 allows communication between containers 14*a* and 14*b* and mixing of the components 30 and 32 of the explosive device. The user may then gently shake the device 10 by, for example, inverting the device 10 several times. This helps to ensure the complete mixing of the components in containers 14*a* and 14*b*, for example the oxidizer 30 and fuel 32, as illustrated in FIG. 10. The user may then position the device 10 in a desired location. Detonation of the device 10 is initiated, for example, by ignition of the detonating cord 26.

Device 10 provides separate compartments to isolate the components of an explosive device, for instance an oxidizer and a fuel, until immediately before use. The components are stable when separated but become combustible when combined. Isolation of the fuel and oxidizer greatly increases safety when transporting explosive devices. In addition, the cost of shipping decreases because of less stringent regulations associated with more stable compounds.

Now, therefore, the following is claimed:

1. A method, comprising:

receiving a hollow structure having a first compartment and a second compartment, wherein the first compartment stores a first explosive component, wherein the second compartment stores a second explosive component, and wherein the first compartment is separated from the second compartment by a separator;

fracturing the separator, wherein the fracturing comprises applying a compressive force by hand to the separator; and mixing the first and second explosive components within the hollow structure, wherein the mixing comprises passing at least one of the explosive components through the fractured separator causing the first and second explosive components to mix, wherein mixing the first explosive component with the second explosive component produces an explosive compound.

2. The method of claim 1, wherein the hollow structure has a first opened end and a second opened end, and wherein the method further comprises:

securing a first cap to the first opened end thereby sealing the first compartment; and securing a second cap to the second opened end thereby sealing the second compartment.

3. The method of claim 2, wherein the first opened end is opposite of the second opened end.

4. A method, comprising:

inserting a first explosive component into a first compartment of a hollow structure;

inserting a second explosive component into a second compartment of the hollow structure, wherein the first compartment is separated from the second compartment by a separator;

applying a compressive force to the separator by hand thereby fracturing the separator; and mixing the first and second explosive components within the hollow structure through the fractured separator thereby forming an explosive compound within the hollow structure.

5. The method of claim 4, further comprising:

sealing the first compartment while the first explosive component is in the first compartment; and sealing the second compartment while the second explosive component is in the second compartment.

6. The method of claim 4, wherein the inserting the first explosive component is performed through a first opened end of the hollow structure, wherein the inserting the second explosive component is performed through a second opened end of the hollow structure, and wherein the method further comprises:

securing a first cap to the first opened end thereby sealing the first compartment; and securing a second cap to the second opened end thereby sealing the second compartment.

7. The method of claim 6, wherein the first opened end is opposite of the second opened end.

8. A method, comprising:

providing an elongated hollow structure having a first opened end and a second opened end, wherein the elongated hollow structure is coupled to a separator;

inserting a first explosive component into a first compartment of the elongated hollow structure through the first opened end;

inserting a second explosive component into a second compartment of the elongated hollow structure through the second opened end, wherein the first compartment is separated from the second compartment by the separator;

securing a first cap to the first opened end of the elongated hollow structure, thereby sealing the first compartment of the elongated hollow structure;

securing a second cap to the second opened end of the hollow structure, thereby sealing the second compartment of the elongated hollow structure;

fracturing the separator by applying a compressive force by hand to the separator; and mixing the first and second explosive components within the elongated hollow structure, wherein the mixing comprises passing at least one of the explosive components through the fractured separator causing the first and second explosive components to mix, wherein mixing the first explosive component with the second explosive component produces an explosive compound.

9. The method of claim 8, wherein the first opened end is opposite of the second opened end.

10. The method of claim 8, wherein the elongated hollow structure has a first tube defining the first compartment and a second tube defining the second compartment, the first tube having the first opened end and a third opened end, the second tube having the second opened end and a fourth opened end, wherein the passing comprises passing the at least one of the explosive components through the third opened end and the fourth opened end.

11. The method of claim 10, wherein the separator is between the third opened end and the fourth opened end.

12. The method of claim 11, wherein the third opened end is joined to the separator.

13. The method of claim 12, wherein the fourth opened end is joined to the separator.

14. The method of claim 2, wherein the hollow structure has a first tube defining the first compartment and a second tube defining the second compartment, the first tube having the first opened end and a third opened end, the second tube having the second opened end and a fourth opened end.

15. The method of claim 14, further comprising:

inserting the first explosive component into the first compartment through the first opened end; and inserting the second explosive component into the second compartment through the second opened end.

16. The method of claim 14, wherein the third opened end is joined to the separator.

17. The method of claim 16, wherein the separator is between the third opened end and the fourth opened end.

18. The method of claim 17, wherein the fourth opened end is joined to the separator.

19. The method of claim 6, wherein the hollow structure has a first tube defining the first compartment and a second tube defining the second compartment, the first tube having the first opened end and a third opened end, the second tube having the second opened end and a fourth opened end.

20. The method of claim 19, further comprising:

inserting the first explosive component into the first compartment through the first opened end; and inserting the second explosive component into the second compartment through the second opened end.

21. The method of claim 20, wherein the third opened end is joined to the separator.

22. The method of claim 21, wherein the separator is between the third opened end and the fourth opened end.

23. The method of claim 22, wherein the fourth opened end is joined to the separator.

* * * * *